US008863848B2

(12) United States Patent
Elrick et al.

(10) Patent No.: US 8,863,848 B2
(45) Date of Patent: Oct. 21, 2014

(54) FLOW CONTROL APPARATUS AND METHOD

(75) Inventors: Andrew Elrick, Peterhead (GB); David Jenner, Aberdeen (GB)

(73) Assignee: Petrowell Limited, Aberdeenshire (GB)

( * ) Notice: Subject to any disclaimer, the term of this patent is extended or adjusted under 35 U.S.C. 154(b) by 630 days.

(21) Appl. No.: 13/145,824

(22) PCT Filed: Jan. 27, 2010

(86) PCT No.: PCT/GB2010/050126

§ 371 (c)(1),
(2), (4) Date: Sep. 27, 2011

(87) PCT Pub. No.: WO2010/086654

PCT Pub. Date: Aug. 5, 2010

(65) Prior Publication Data

US 2012/0031623 A1 Feb. 9, 2012

(30) Foreign Application Priority Data

Jan. 27, 2009 (GB) ..... 0901257.6

(51) Int. Cl.

| | |
|---|---|
| ***E21B 34/06*** | (2006.01) |
| ***E21B 43/08*** | (2006.01) |
| ***E21B 34/10*** | (2006.01) |
| *E21B 34/00* | (2006.01) |

(52) U.S. Cl.

CPC ..... *E21B 34/103* (2013.01); *E21B 2034/007* (2013.01)

USPC ..... 166/369; 166/316; 166/319

(58) Field of Classification Search

USPC ..... 166/373, 321, 387, 319, 334.4, 381, 166/369, 179, 317, 205, 316

See application file for complete search history.

(56) References Cited

U.S. PATENT DOCUMENTS

| | | | | |
|---|---|---|---|---|
| 4,429,747 | A | 2/1984 | Williamson, Jr. | |
| 5,609,178 | A * | 3/1997 | Hennig et al. | 137/10 |
| 6,220,357 | B1 * | 4/2001 | Carmichael et al. | 166/321 |
| 7,416,029 | B2 * | 8/2008 | Telfer et al. | 166/386 |
| 8,657,018 | B2 * | 2/2014 | Cravatte | 166/376 |
| 2004/0000406 | A1 | 1/2004 | Allamon et al. | |
| 2008/0283252 | A1 * | 11/2008 | Guignard et al. | 166/381 |
| 2009/0133869 | A1 * | 5/2009 | Clem | 166/250.15 |
| 2009/0173503 | A1 * | 7/2009 | Corbett et al. | 166/373 |
| 2011/0100643 | A1 * | 5/2011 | Themig et al. | 166/373 |
| 2011/0139465 | A1 * | 6/2011 | Tibbles et al. | 166/387 |
| 2012/0031623 | A1 * | 2/2012 | Elrick et al. | 166/369 |

FOREIGN PATENT DOCUMENTS

| | | |
|---|---|---|
| EP | 0618345 A1 | 10/1994 |
| GB | 2247481 A | 4/1992 |
| GB | 2327445 A | 1/1999 |

* cited by examiner

*Primary Examiner* — Daniel P Stephenson

(74) *Attorney, Agent, or Firm* — Wong, Cabello, Lutsch, Rutherford & Brucculeri LLP

(57) ABSTRACT

An apparatus for controlling the flow of downhole fluids comprises a body having a throughbore and at least one port extending through a sidewall of the body to enable fluid communication between the throughbore and an exterior of the body. The apparatus comprises a flow control device for controlling the flow of fluids through the port. The flow control device is arranged to change configuration between a closed configuration in which fluid flow through the port is restricted and an open configuration in which fluid flow through the port is permitted. The apparatus further comprises an actuator mechanism associated with the flow control device for selective actuation of the flow control device to change the configuration of the flow control device between the closed and open configurations. The apparatus further comprises a locking device to lock the configuration of the flow control device, and an unlocking mechanism to unlock the locking device and to permit the actuator mechanism to change the configuration of the flow control device.

12 Claims, 9 Drawing Sheets

FLOW CONTROL APPARATUS AND METHOD

CROSS REFERENCE TO RELATED APPLICATIONS

The present application is a 35 U.S.C. §371 national stage filing of International Patent Application No. PCT/GB2010/050126, filed Jan. 27, 2010, and through which priority is claimed to Great Britain Patent Application No. 0901257.6, filed Jan. 27, 2009, the disclosures of which are incorporated herein by reference in their entireties.

The present invention concerns an apparatus and a method for controlling the flow of downhole fluids. Typically the invention relates to apparatus and a method for controlling the inflow of hydrocarbon-rich production fluids into production tubing in an oil or gas well.

In the recovery of hydrocarbons from an underground formation, a borehole is drilled and production tubing is run into the borehole to allow hydrocarbon production from various zones of the formation. Different zones can be richer in hydrocarbons than others, and it is common to equip the production tubing with inflow control devices to produce fluids from some zones and not from others. To this end, the production tubing has a number of ports through which hydrocarbons can be produced, frequently surrounded by sandscreens that restrict ingress of formation particles such as rocks and sand above a predetermined size through each port and into the tubing, and in order to isolate productive zones of the formation, the annulus between the borehole and the production tubing is usually isolated by a packer in the transition region between each zone to substantially restrict the cross-flow of hydrocarbons between any one zone and an adjacent zone. Thus it is possible to produce form one zone of a formation, where the production fluids might be very rich in hydrocarbons, and avoid production from another zone, in which the production fluids might contain more water or corrosive fluids, and might be less economical or more difficult or dangerous to produce.

According to a first aspect of the invention, there is provided an apparatus for controlling the flow of downhole fluids, the apparatus comprising:

a body having a throughbore, with at least one port extending through a sidewall of the body to enable fluid communication between the throughbore and an exterior of the body; a flow control device for controlling the flow of fluids through the port, and arranged to change configuration between a closed configuration, in which fluid flow through the port is restricted, and an open configuration in which fluid flow through the port is permitted; and an actuator mechanism associated with the flow control device for selective actuation of the flow control device to change the configuration of the flow control device between the closed and open configurations; a locking device to lock the configuration of the flow control device; and an unlocking mechanism to unlock the locking device, and to permit the actuator mechanism to change the configuration of the flow control device.

The flow control device can optionally be initially arranged in the closed configuration to substantially obturate the port.

The flow control device can also be actuable in a plurality of intermediate configurations between the open and the closed configurations. The intermediate configurations can permit a degree of fluid communication between the throughbore and the exterior of the body such that the area of the port is restricted to a certain degree relative to the fully open position. Thus, fluid flow through the port can be choked to control the flow of fluids downhole.

The flow control device can comprise a sliding sleeve.

Optionally the flow control device can control first and second (or more) ports, typically spaced apart from one another and typically controlling inflow of fluids into production tubing from two production zones in a subterranean formation. The first port can be capable of communicating with a first production zone and the second port can be capable of communicating with a second production zone. Preferably, the first and second production zones are distinct separate zones within the formation.

The body can be a tubular body. The second port can be spaced axially relative to the first port. The tubular body can be provided with appropriate end connections to enable connection of the apparatus as part of a pipe string.

The actuator mechanism can comprise a resilient device, such as a spring, typically a coiled spring, although other types of resilient device can work equally well, such as a gas spring, or an elastomeric material. The spring typically biases the flow control device into the open configuration.

The locking device can typically lock the flow control device in one configuration, typically the closed configuration, against the bias of the spring urging the flow control device into the open configuration.

The locking device can comprise a shear pin or shear screw. The shear pin can optionally lock the flow control device to the tubular in the closed configuration, typically preventing axial movement of the two and keeping the port closed.

The unlocking mechanism can be pressure operated, and can optionally comprise a piston configured to move under pressure, typically within the throughbore, to remove, destroy, or change the configuration of the locking device. The locking device can comprise a shear pin, typically connected between the body and the piston. The piston can optionally be formed as part of the flow control device, typically by providing the flow control device in the form of a sleeve adapted to obturate the port, with a number of different sealed areas on the sleeve.

Typically the removal or triggering of the locking device to unlock the flow control device allows the flow control device to move under the bias of the actuator mechanism, such as the spring, from the closed configuration, to the open configuration.

The body can be coupled to one or more portions of slotted screen. The slotted screen can typically have a greater radial extent than the body. In embodiments where there is more than one port, a first portion of slotted screen can optionally communicate with a first port and extend axially in one direction and a second portion of slotted screen can communicate with a second port and extend axially in an opposing direction. The portions of slotted screen can be sandscreen.

A first fluid flow path can be defined between the first portion of slotted screen and the first port and a second fluid flow path can be defined between the second portion of slotted screen and the second port. The first fluid flow path can be arranged to allow flow of fluids therethrough in an opposing direction relative to the flow of fluids through the second fluid flow path.

The portion of slotted screen can be incorporated as part of a sandscreen sub. Each end of the body can be coupled to a sandscreen sub. The slotted screen can be coaxial with the body. The size of the slotted screen mesh can be determined according to the maximum acceptable size of formation particles travelling through the ports and into the throughbore.

An isolator can be provided on the exterior of the body, optionally located between first and second ports. The isolator can substantially fluidly isolate adjacent ports by obturating an external annulus surrounding the apparatus. The isolator can comprise a packer. The packer can be swellable upon contact with downhole fluids, or can be inflatable. The packer can be a hydraulic set packer or can be set by another type of signal, e.g. RFID.

The actuator mechanism can be arranged to actuate movement of the flow control device into the open configuration.

The flow control device can be biased into the open configuration. The flow control device can be retained in the closed configuration by the locking device. The flow control device can be initially retained in the closed configuration by restraining movement of the flow control device relative to the body. The unlocking mechanism can be arranged to remove the restraint of the locking device and permit relative movement of the flow control device and the body, such that the flow control device moves from the closed configuration to the open configuration under the force of the actuator mechanism.

The actuator mechanism can be accommodated by at least one of the body or the flow control device.

The flow control device can be sealed against the body and relative movement of the flow control device and the body can be constrained to the axial direction.

Typically the invention permits the use of tubing pressure to unlock a locking mechanism between a flow control device and a tubular, to change the configuration of the flow control device from a locked position, into an unlocked configuration, and to store energy in an actuation device, typically as a result of the pressurisation, to open a port in the tubular, by forcing a configuration change in the flow control device from a closed configuration to an open configuration, after removal of the tubing pressure maintaining the flow control device in the unlocked configuration, and release of the stored energy in the actuation device.

According to a second aspect of the invention there is provided a method of producing fluids from a formation around a borehole in an underground formation, the method comprising:

(a) providing a tubular in the borehole, the tubular having a throughbore and at least one port extending through a sidewall of the tubular;

(b) obturating the port by configuring a flow control device in a closed configuration, to restrict the passage of fluids through the port and into the throughbore of the tubular;

(c) locking the flow control device in the closed position against the bias of a resilient device;

(d) unlocking the flow control device from the closed position, thereby permitting it to change configuration to an open configuration, thereby permitting fluids to pass through the port and into the throughbore of the tubular; and (e) recovering fluids from the throughbore of the tubular.

Features and steps of the first aspect of the invention can also be applicable to the second aspect of the invention where appropriate.

The apparatus and method of the first and second aspects of the invention is especially although not exclusively suited for use in deviated or horizontal wells.

Embodiments of the present invention will now be described with reference to the accompanying figures in which.

Figure 1:
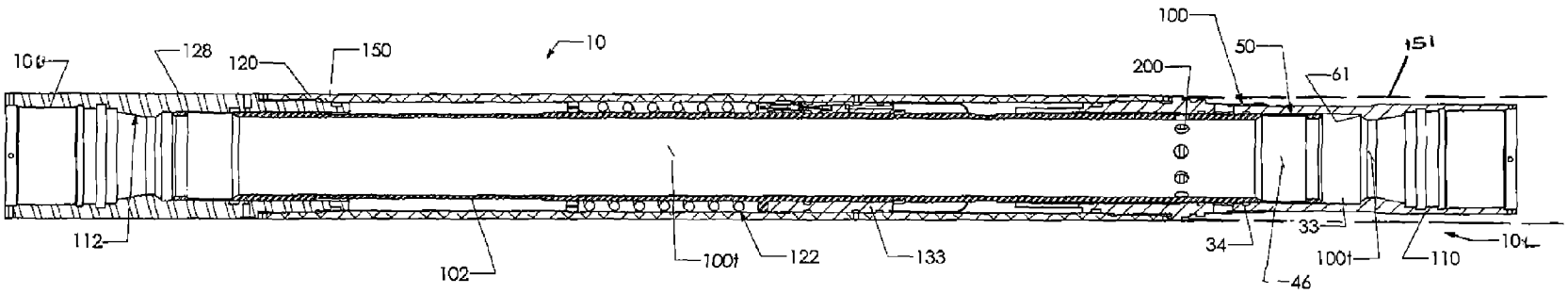
FIG. 1 is a sectional view of an apparatus in a closed configuration.

One embodiment of apparatus 10 for controlling flow of downhole fluids is shown in a closed configuration in FIGS. 1 to 5. The apparatus 10 comprises a flow control device in the form of a generally cylindrical hollow flow control sleeve 50, surrounded by a generally cylindrical hollow outer body in the form of an outer tubular 100. The flow control sleeve 50 is housed within a throughbore **100*t* in the outer tubular 100 and the flow control sleeve 50 has a throughbore 46 that is concentric with the throughbore 100*t* of the outer tubular 100. The flow control sleeve 50 can optionally comprise several individual lengths of conjoined tubing, but in this example, it comprises a single sleeve. The outer tubular 100 in this example can comprise a single sleeve, but in this example the outer tubular 100 is made up from sequentially connected portions of outer housing comprising a sandscreen sub 110, a piston housing 150 and a top sub 128. The housing portions 110-150 are typically rigidly connected together in this embodiment, for example by screw threads between sandscreen sub 110 and piston housing 150 and by set screws between the remaining components and top sub 128. The easily removable set screws allow the removal of the top sub 128** for maintenance or replacement of components. In other embodiments the outer housing can comprise different conjoined housing components.

Figure 6:
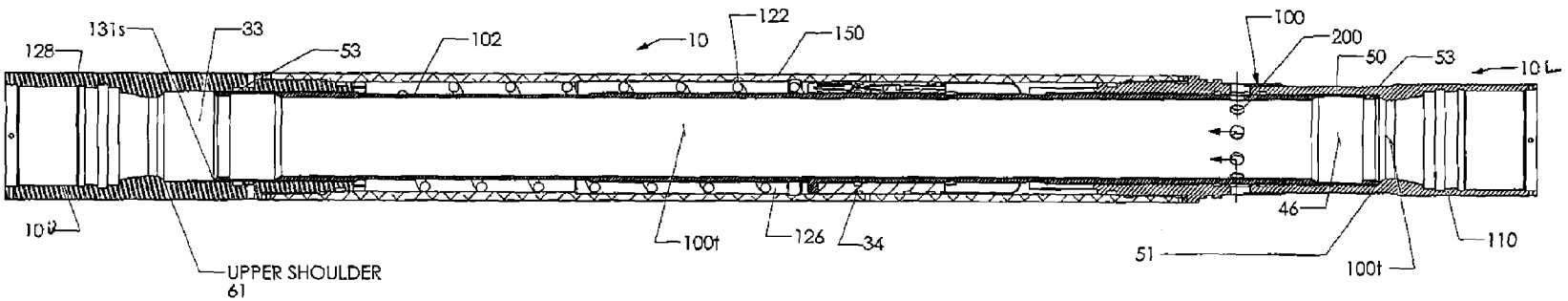
FIG. 6 is a sectional view of the apparatus of FIG. 1 in an open configuration.

A right hand end 10L of the apparatus 10 shown in the drawings in FIGS. 1 and 6 is located upstream (e.g. furthest downhole) of a left hand end **10*u* of the apparatus in use. Therefore the left hand end 10*u* of the apparatus 10 in FIGS. 1 and 6 is the closest part of the apparatus 10** to the surface in use.

The outer tubular 100 surrounds an inner tubular 102 that is co-axial with the throughbore **100*t* of the outer tubular 100 and with the throughbore 46 of the flow control sleeve 50. The lower end of the inner tubular 102 is advantageously configured to connect to a tubing string below the outer tubular 100, which may include other devices similar to the apparatus 10 herein described, so that several pieces of apparatus 10** can be chained together.

Figure 2:
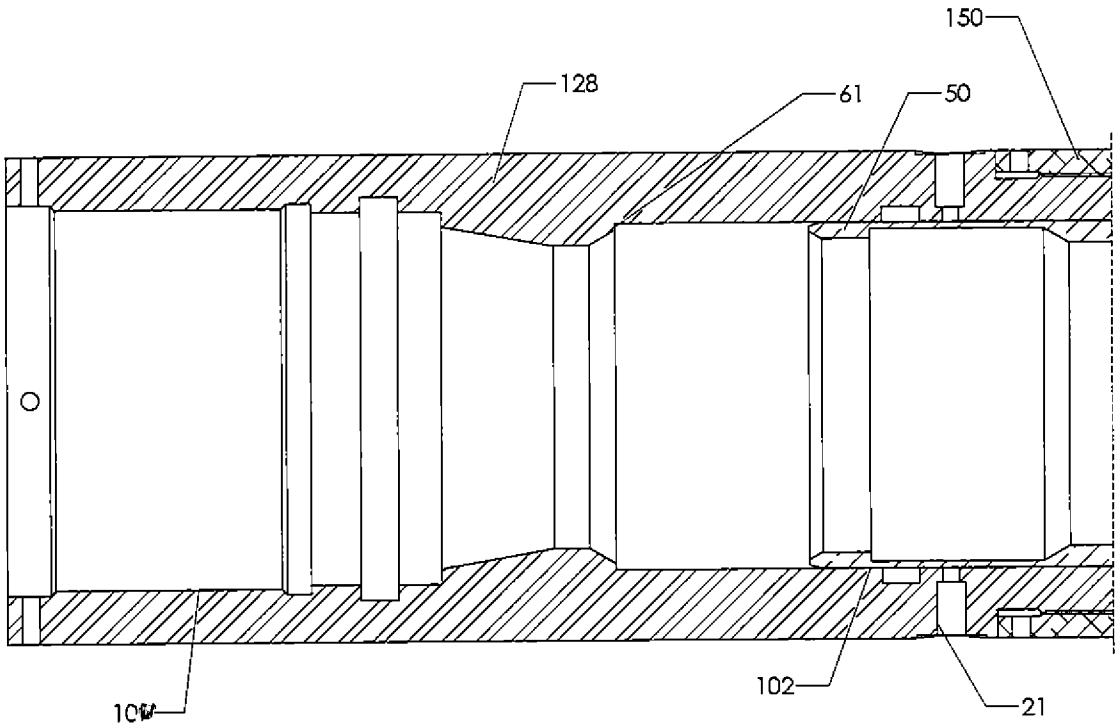
FIGS. 2 to 5 are detailed sectional views of sequential portions of FIG. 1.
Figure 3:
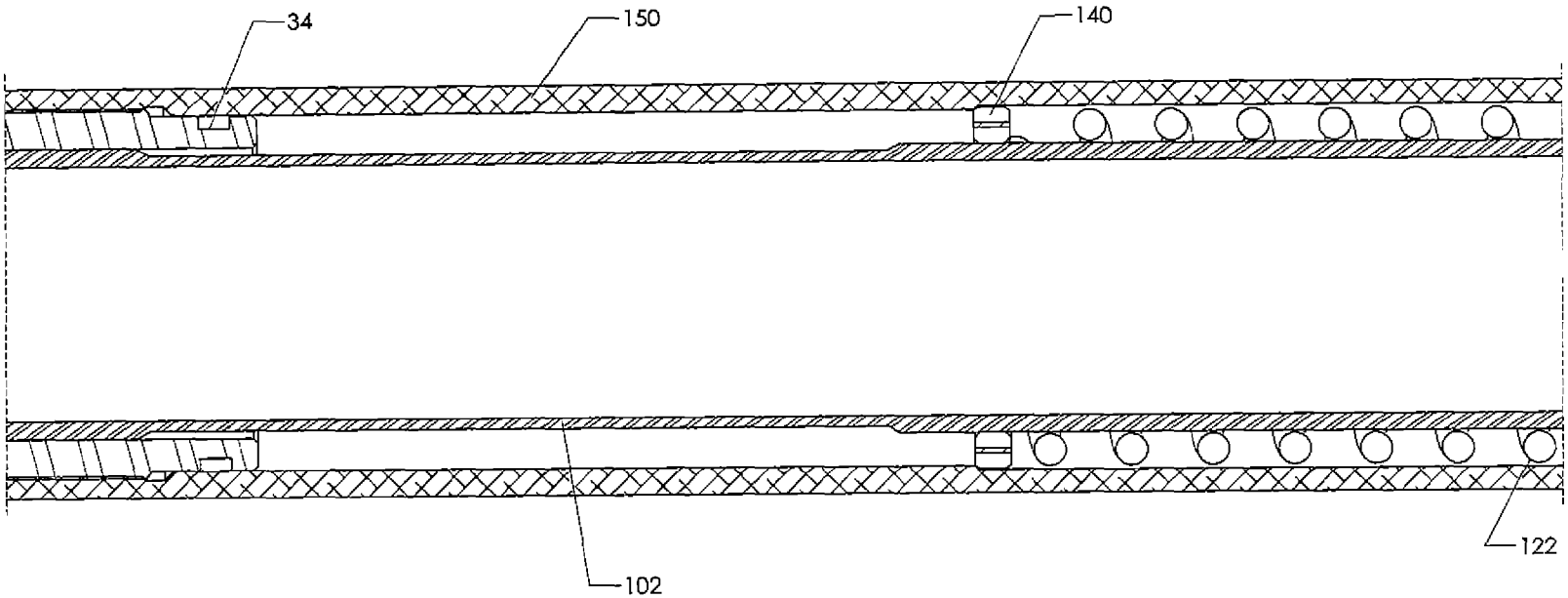
Figure 4:
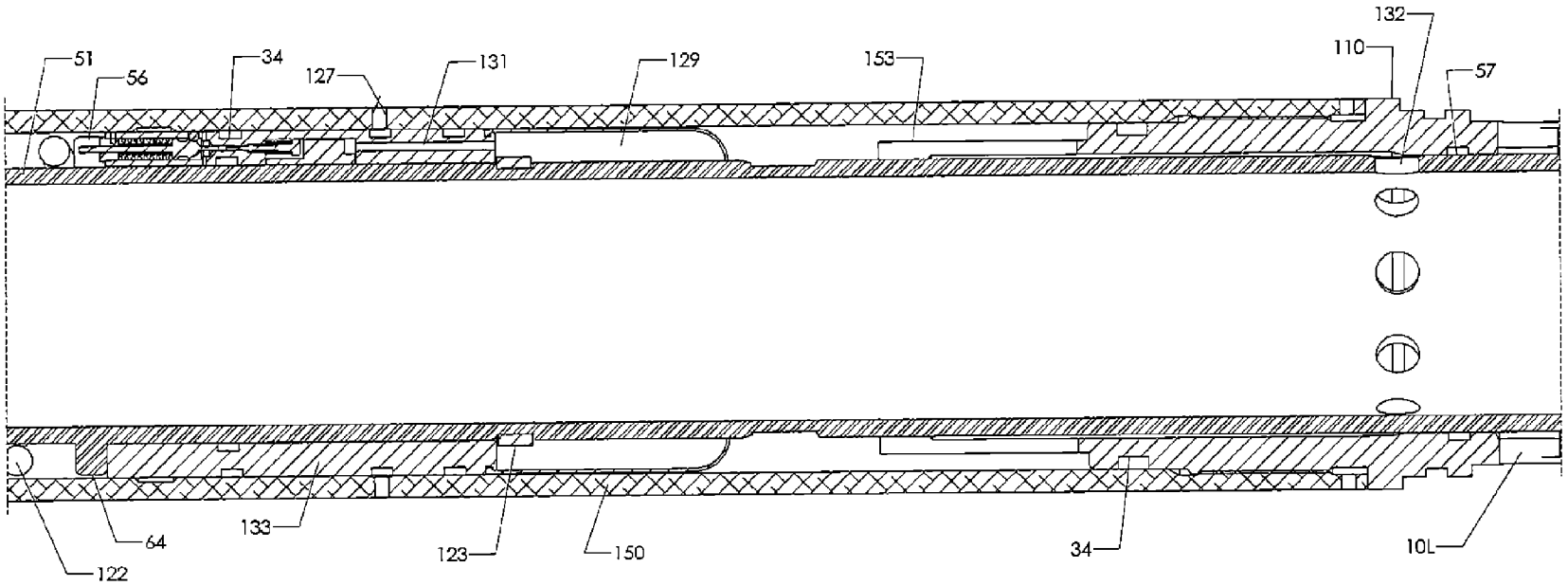
Figure 5:
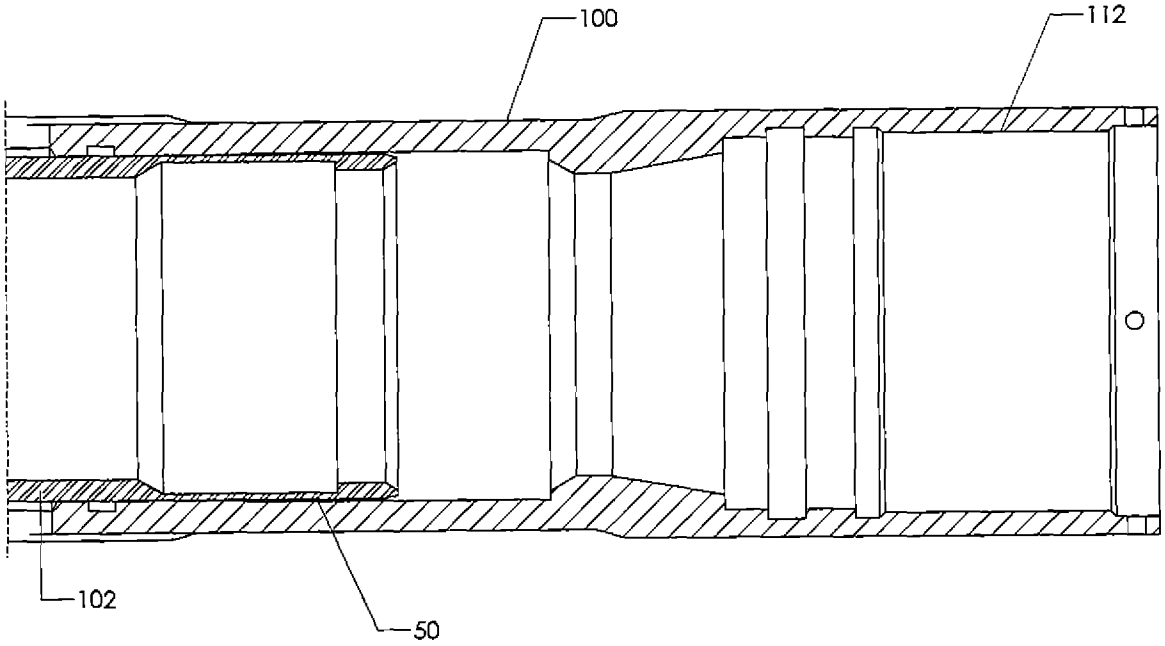
Figure 7:
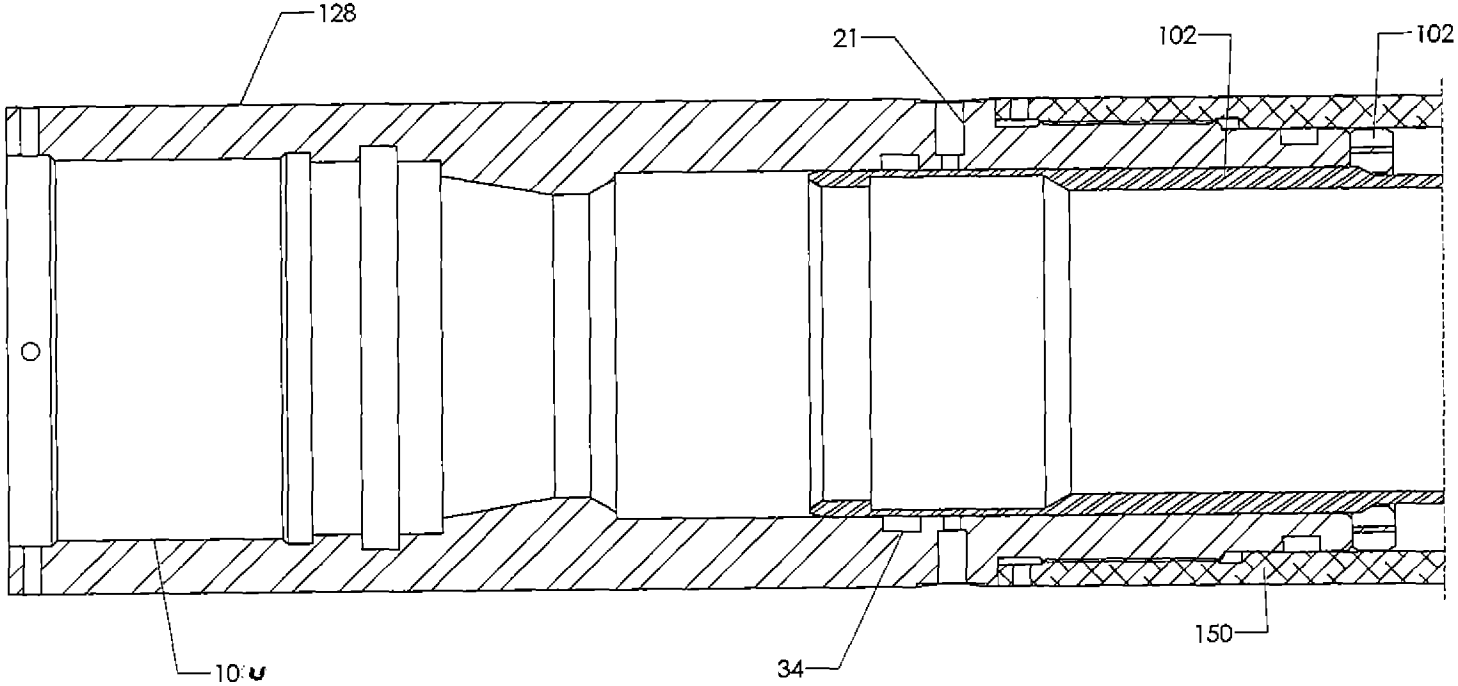
FIGS. 7-10 are detailed sectional views of sequential portions of FIG. 6.
Figure 8:
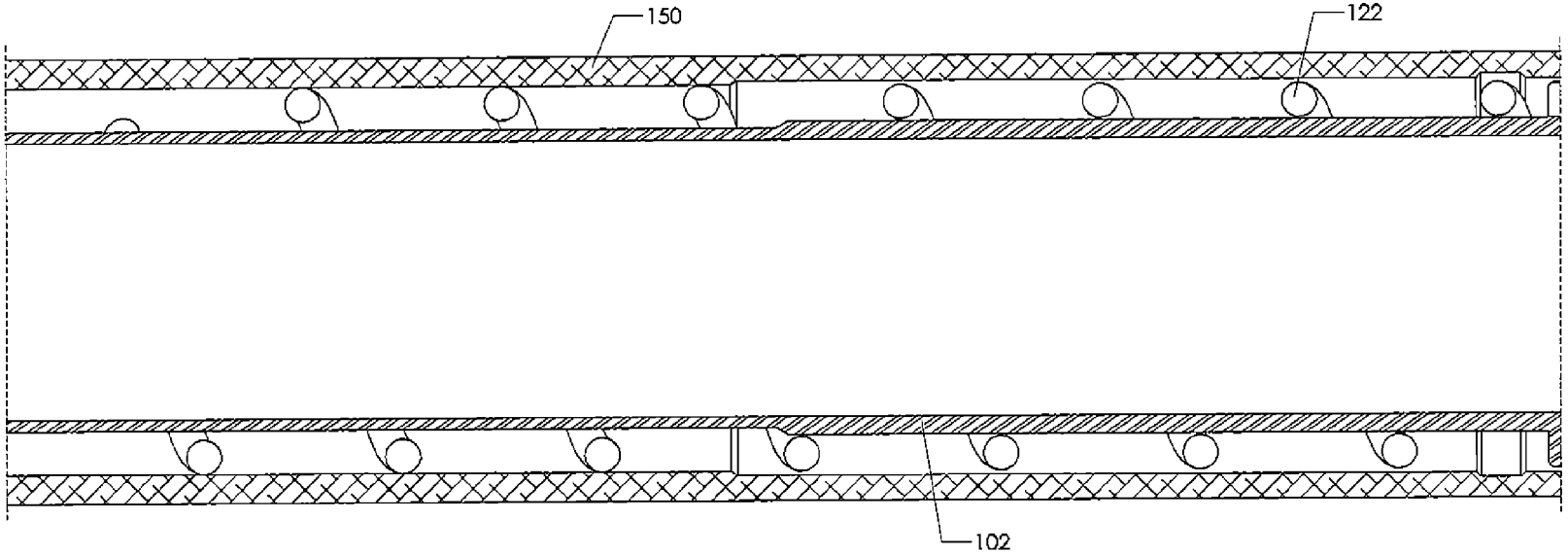
Figure 9:
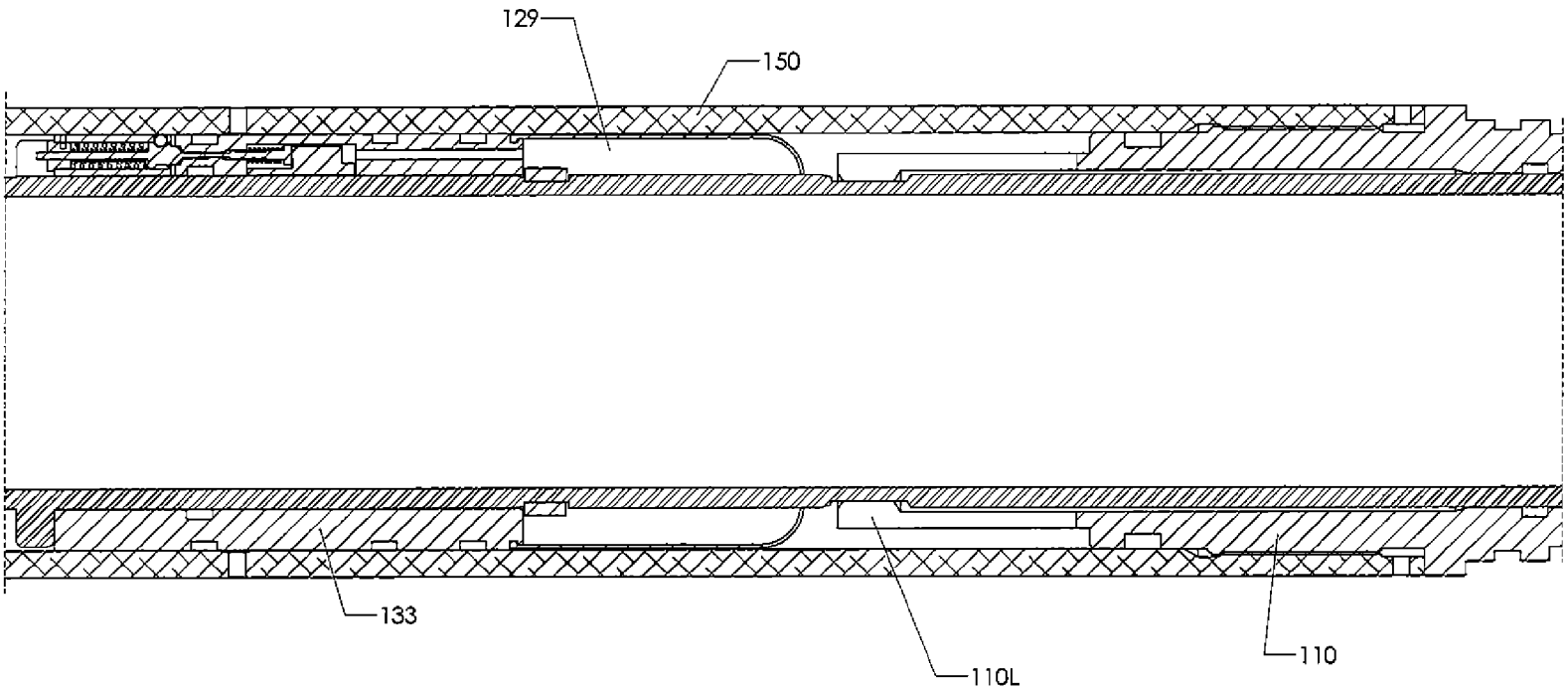
Figure 10:
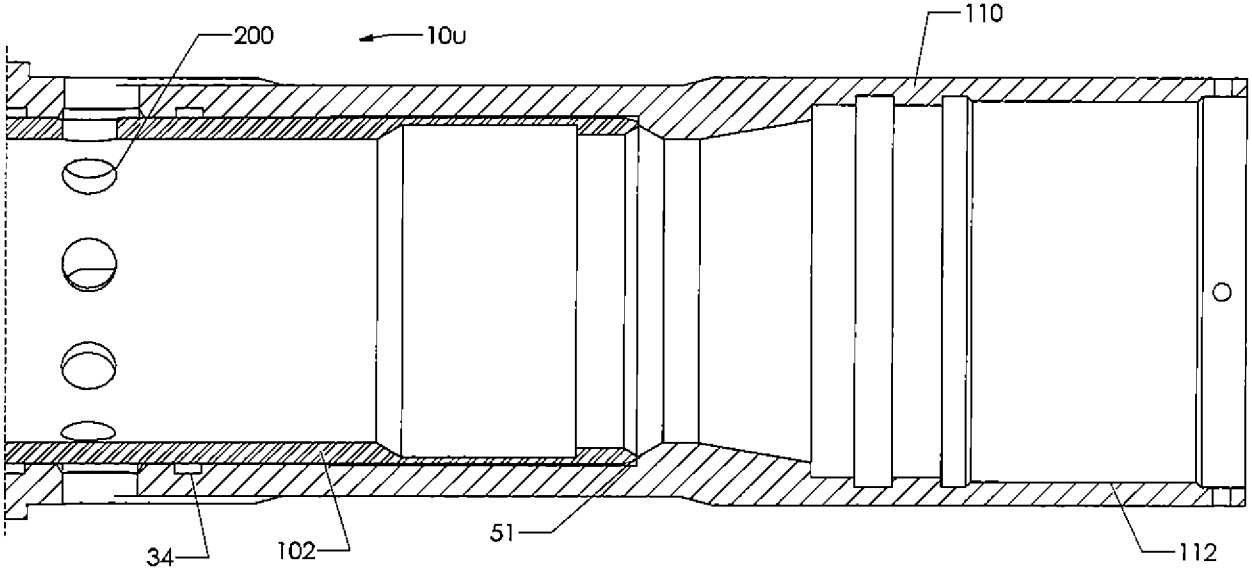

Starting at the upstream (lowermost) end shown in FIGS. 1 and 2, the sandscreen sub 150 that forms part of the outer tubular 100 carries a length of adjacent sandscreen 151, and the throughbore **100*t* of the inner tubular 102 is adapted to be connected to a string of production tubing below the apparatus, as is known in the art. The sandscreen 151 admits production fluids from the reservoir zone immediately outside the sandscreen into an annular channel 120 between the inner tubular 102 and the outer tubular 100, extending parallel to the axis of the throughbore 46. The produced fluids cannot pass through the inner tubular 102, and as a result, they flow into the annular channel 120. The lower end of the inner tubular 102 is ported to fluidly connect the formation outside the apparatus with an interior of the outer tubular 100 via the annular channel 120. Typically the annular bore 33 interconnects the axial bores 120, but it would be possible to have a single radial port for each axial bore 120** instead.

The inner tubular 102 is ported. Typically the ports 200 in the inner tubular flow control sleeve correspond to the inner diameter of the inner tubular 102, and can vary in different embodiments. In this example the outer diameter is typically 3.995 inches (10.147 centimeters). Typically the diameter of the flow control sleeve corresponds to the inner diameter of the inner bore of the sand screen sub 110, and in this example is 4.002 inches (10.165 centimeters). Clearly the diameters of these sections can be varied in different embodiments of the invention.

Between the upper and lower portions 51, 55 there is an upwardly facing shoulder 56. A spring 122 is located in an annular cavity 126 between the shoulder 56 and the snap ring 140 so that the spring 122 is held between the shoulder 56 and the upper face snap ring 140. The piston 133 has a radial hole in which a shear pin 127 is received. The inner end of the shear pin 127 is threaded through the piston housing 150 into a recess so that when the shear pin 127 is engaged with the recess, the inner sleeve is axially immovable within the bore. The shear pin 127 is adapted to shear at the interface between the inner surface of the piston housing 150 and the outer surface of the piston 133 allowing the piston 133 to slide axially within the piston housing 150.

When disengaged from the shear pin 127, the piston 133 is slidable in the annulus 126 of the outer tubular 150, between an upwardly facing annular shoulder 56 formed in the flow control sleeve 50.

When the apparatus 10 is in the closed configuration shown in FIGS. 1-5, the flow control sleeve 50 is held by the shear pin 127 in a position in which the spring 122 is compressed within the cavity 126, and the upper end of the flow control sleeve 50 closes off the ports 200. Annular seals 34 are provided in grooves on an inner surface of the sand screen sub 110 to fluidly isolate the ports 200 from the throughbore 132 in the closed configuration, so that when the flow control sleeve 50 covers the ports 200, the seals prevent fluid communication between the inside of the bore 100*t* and the formation outside of the apparatus 10.

When the shear pin 127 is disengaged from the flow control sleeve 50, the flow control sleeve 50 is urged by the spring 122 into the open configuration within the cavity 126, as shown in FIGS. 6-10, with the spring 122 expanded within the annular cavity 126 and the upper portion 55 of the flow control sleeve 50 pushed up by the force of the spring 122 against the upper shoulder 61. This axial movement of the inner sleeve upwards in the bore 100*t* of the outer tubular 100 uncovers the ports 200 as shown in FIG. 6, and allows fluid communication (shown by the arrows in FIG. 6) between the inside of the bore 100*t* and the formation outside of the apparatus 10. Typically the piston 133 has a valved port 131 (FIG. 4) allowing pressure equalisation between the cavity 126 inside the sleeve 150 and the spring bore, so that pressure locks do not affect the movement of the spring 122 or the flow control sleeve 50 within the cavity.

Additionally, the sandscreen sub 110 optionally has a threaded internal box end 112 to allow the throughbore 100*t* to be connected to an adjacent length of pipe above the sandscreen sub 110.

Prior to use, the external pin ends of the apparatus 10 are each joined to sandscreen subs (not shown). Each sandscreen sub comprises a portion of slotted screen that allows hydrocarbons to be produced therethrough, but substantially restricts ingress of rocks and sands. The sandscreen sub attached to the upper end 101 extends axially downstream (toward the surface).

The interior of the apparatus 10 is joined at either end to lengths of pipe (not shown) with pin connections that engage with the threaded box connections at each end. The individual lengths of pipe are joined and sealed to one another to form continuous hollow tubing referred to as production tubing. Across its full length, the production tubing can incorporate several sand screen subs and associated apparatus 10. Other down hole devices can also be incorporated into the production tubing as appropriate. The apparatus 10 is located at a predetermined position along the production tubing so that once run in; the adjacent slotted screen of the sand screen subs is positioned in respective production zones of the surrounding formation that contain hydrocarbon reservoirs of interest.

Once the well is ready to be completed, the production tubing containing the apparatus 10 and the sand screen subs is run down hole with the flow control sleeve 50 in the closed position in which the ports 200 are substantially obturated by the flow control sleeve 50 to restrict fluid flow into the throughbore 46. The apparatus 10 is arranged such that the sandscreen sub attached to the upper end 10*u* has a region of slotted screen extending axially downstream in a downstream hydrocarbon zone of a formation. The sandscreen sub optionally attached to the upper end 10*u* is typically arranged with a region of slotted screen in a separate upstream zone of the formation. Once the apparatus 10 is located downhole in the most suitable location, the packers optionally located between screens are expanded to seal off the annulus, for example by allowing hydrocarbons to be absorbed by swellable packers, or by inflating inflatable packers to fluidly isolate the upstream and downstream reservoir zones. Optionally fluid can be circulated through the string at this point, with the ports closed, so that circulating fluids pass through the bore 100*t* and through the lower open end of the string, allowing well cleanup and testing operations to be carried out before the ports are opened.

When the whole of the string is in the desired position and an operator wishes to move the apparatus 10 into the open configuration and initiate production through the sand screen subs, the string is plugged at the bottom, usually by dropping a ball or a dart into a catcher (not shown) at the bottom of the string, or by activating a flapper valve or the like, typically during circulation of the fluid in the string; various different methods of closing the string would be acceptable for use with the present invention. The pressure in the throughbore 46, 100*t* is then increased. Normally the first pressure threshold reached activates hydraulic set packers, e.g. at 3000 psi. The pressure continues to increase to activate the flow control sleeves.

Ambient pressure within the throughbore 46 of the flow control sleeve 50 is acting on a greater area at the downstream (upper) end of the flow control sleeve 50 than at its upstream (lower) end because of the difference in the outer diameter 44 of the lower portion of the flow control sleeve 50 at the seals 34 and the outer diameter 64 of the upper portion of the flow control sleeve 50. The differential in sealed areas creates a piston effect and forces the flow control sleeve 50 to move downwards (to the left in the drawings) when sufficient pressure is maintained in the bore 46. However, as the flow control sleeve 50 is connected to the outer tubular 100 by means of the shear pin 127, the shear pin 127 acts as a restraint to restrict relative movement of the outer tubular 100 and the flow control sleeve 50.

As the fluid pressure increases within the bores 100*t*, 46, so does the net downward force applied to the flow control sleeve 50 as a result of the pressure differential arising from the two different piston areas 44, 64. When the net downward force reaches the shear pin shear strength, the shear pins 127 shear, typically at a pressure above the pressure threshold needed to activate the packers, e.g. 3000 psi. Typically the shear pressure reached can be significantly above the shear rating of the pins, to ensure that all of the pins in the string are sheared and each of the ports are unlocked. Typically the pressure applied is around 1000 psi above the shear pin rating. Once the shear pins 127 anchoring the outer tubular 100 to the flow control sleeve 50 have sheared, the restraint previously restricting movement of flow control sleeve 50 relative to the outer tubular 100 is removed. As a result of the pressure differential created by the increased diameter 44 relative to the diameter 64, the flow control sleeve 50 is urged by the high downhole pressure in the downward direction and can continue to move down until the bottom of the lower portion 51 abuts against the upper face of the shoulder 131*s* which prevents it's further travel.

Typically relative piston areas and the shear pin shear strength is chosen in conjunction with the strength of the spring 122, so that the net downward force applied to the flow control sleeve 50 at the shear pin shear strength is also sufficient to overcome the force of the spring 122 pushing the flow control sleeve 50 upwards. Therefore, as the flow control sleeve 50 moves down relative to the outer tubular 104, the flow control sleeve 50 compresses the spring 122 until the bottom of the lower portion 51 abuts against the upper face of the shoulder 131*s*. This downward movement of the flow control sleeve 50 does not open the ports 200, which remain sealed by the lower portion 51 of the flow control sleeve 50. Therefore, the pressure can be increased to move the sleeves in each of the devices in the string, and simultaneously unlock all of the flow control devices from their locked positions without opening the ports. This is a particular advantage, because it allows for the whole of the string to be unlocked without being opened, despite the fact that some of the shear pins might shear at slightly different forces. It also allows all of the ports to be opened at the same time, by releasing the pressure holding the sleeves in the closed position, and allowing them to move to the open position under the force of the springs. The system can also be set to inflate the packers before or after the unlocking pressure is reached.

When all the shear pins retaining the inner sleeves in the string have sheared and the packers have been set to isolate the desired zones, the pressure can be reduced until the return force of the spring 122 is able to overcome the differential piston force on the flow control sleeve 50. At that point, the flow control sleeve 50 is pushed upwards by the spring 122 and the ports 200 are opened, allowing fluid communication between the formation and the inner bore 100*t* of the tubing.

Once in the open configuration, production of hydrocarbons can commence through the sandscreen subs. Hydrocarbons from the upstream zone will flow in a downstream direction (denoted by arrows in the figures) between the screen 151 and the ports 200. Once the produced hydrocarbons have passed through the ports 200, they enter the throughbore 46 and flow in the downstream direction up the production tubing towards the surface. Fluids produced through the ports 200 can then be recovered from the inner bore 100*t* by known methods.

According to the present embodiment, the outer tubular 100 and the flow control sleeve 50 are optionally manufactured from separate components that are joined to allow the movement of the flow control sleeve 50 and the outer tubular 100 as a single component. However, a multi-piece flow control sleeve 50 arrangement can optionally be provided.

Optionally the flow control sleeve 50 has a fishing neck 53 to allow the flow control sleeve 50 to be mechanically actuated so that it is moveable relative to the outer tubular 104 even if the spring 122 fails to move it. For example, a latch can be used to engage the fishing neck 53 on the flow control sleeve 50 and the latch can be hammered, jarred or pulled to move the flow control sleeve 50 independently of the spring 122.

The present invention optionally allows a single actuator mechanism to operate a sliding sleeve to control the flow of hydrocarbons through two sets of axially spaced ports in respective screens. To enable this development, the relative locations of the two sets of ports in the respective screens can be modified so that they are adjacent the common actuator mechanism, and the flow control sleeve can be extended to cover the two ports. The modified apparatus would still allow hydrocarbons to be collected from different zones in a hydrocarbon formation because the location of the slotted screen extends axially from the apparatus in opposing directions on either side. The apparatus optionally also includes a packer that isolates the exterior of the production tubing between the ports on the respective screens and thus ensures that one set of ports serves one area of the production zone and the other ports on the other screen serve another area of the production zone. The result is a significant cost saving because a single actuator mechanism is required to operate and control a single flow control sleeve but still allows production from two discrete zones. Thus, the number of actuator mechanisms required for a given number of sleeves and porting arrangements is cut by half.

According to the above example, the flow control sleeve 50 occupies an initial closed configuration and is subsequently moved to the open configuration. However, this sequence could be reversed, and/or the flow control sleeve 50 and the outer tubular 100 could be modified so as to allow the flow control sleeve 50 to be moved into a variety of intermediate configurations in which the flow control sleeve 50 partially obturates the ports to selectively restrict or choke but not completely stop the flow of fluids.

Modifications and improvements can be made without departing from the scope of the invention. For example, pressure pulses could be used to activate the system, rather than a pressure threshold. Instead of a shear pin the locking device can be a eutectic pin, a Kevlar string, a shape memory alloy, a frangible bolt or pin, an explosive bolt or pin, or a detonator cap. In some embodiments, the pin can be pulled out from engagement with the sleeve, e.g. with a motor, rather than breaking at a threshold. Various embodiments of the invention allow the advantage that where a production string has a number of flow control devices arranged in the production string to open ports that produce from the most efficient zones, then these ports can all be opened together when the well is ready for production, avoiding complexities arising from different shear pins shearing at different forces. The ports can optionally be obturated by components other than sleeves. For example actuation of the mechanism for moving the sleeve 102 between the closed and open configuration can cause movement of a plate rather than the sleeve 102 to allow the ports to be selectively opened. In the above example, the packers optionally located between screens typically inflatable packers that expand with the increased pressure applied to trigger the sleeve 50, but swellable packers could be used instead or as well, allowing hydrocarbons to be absorbed by swellable packers to fluidly isolate the upstream and downstream reservoir zones.

Typically the shear ratings of the shear screws can all be the same, so that all of the ports in the string can be opened at the same time. However, different flow control sleeves within the same string can optionally be restrained by shear pins with different ratings, so that e.g. one part of the string with shear pins of 2000 psi rating can be opened before sleeves in another part of the string held by pins with 2500 psi rating, etc.

The invention claimed is:

1. An apparatus for controlling the flow of downhole fluids, the apparatus comprising:

a body having a throughbore and at least one port extending through a sidewall of the body to enable fluid communication between the throughbore and an exterior of the body;

a flow control device for controlling the flow of fluids through the port and arranged to change configuration between a closed configuration in which fluid flow through the port is restricted and an open configuration in which fluid flow through the port is permitted;

an actuator mechanism associated with the flow control device for selective actuation of the flow control device to change the configuration of the flow control device between the closed and open configurations;

a locking device to lock the configuration of the flow control device; and an unlocking mechanism to unlock the locking device and to permit the actuator mechanism to change the configuration of the flow control device, wherein the unlocking mechanism is pressure operated and comprises a piston configured to move under pressure to remove, destroy or change the configuration of the locking device, and wherein the piston has a valved port to allow pressure equalisation between opposite axial sides of the piston.

2. An apparatus as claimed in claim 1, wherein the actuator mechanism comprises a resilient device.

3. An apparatus as claimed in claim 2, wherein the locking device is adapted to lock the flow control device in one configuration against the bias of the resilient device.

4. An apparatus as claimed in claim 1, wherein the unlocking of the locking device by the unlocking mechanism allows the flow control device to move under the bias of the actuator mechanism from the closed configuration to the open configuration.

5. An apparatus as claimed in claim 1, wherein the body is coupled to one or more portions of slotted screen.

6. An apparatus as claimed in claim 1, wherein the locking device comprises a shear pin or shear screw.

7. An apparatus as claimed in claim 1, wherein the actuator mechanism is arranged to actuate movement of the flow control device into the open configuration, wherein the flow control device is biased towards the open configuration, and wherein the control device is retained in the closed configuration by the locking device.

8. An apparatus as claimed in claim 1, wherein the flow control device is initially retained in the closed configuration by restraining movement of the flow control device relative to the body.

9. An apparatus as claimed in claim 8, wherein the unlocking mechanism is arranged to remove the restraint of the locking device and permit relative movement of the flow control device and the body such that the flow control device moves from the closed configuration to the open configuration under the force of the actuating mechanism.

10. An apparatus as claimed in claim 1, wherein the flow control device is sealed against body and relative movement of the flow control device and the body is constrained to the axial direction.

11. An apparatus as claimed in claim 1, wherein the valved port allows pressure equalisation between two chambers arranged on opposite axial sides of the piston.

12. A method of producing fluids from a formation around a borehole in an underground formation, the method comprising:

(a) providing a tubular in the borehole, the tubular having a throughbore and at least one port extending through a sidewall of the tubular;

(b) obturating the port by configuring a flow control device in a closed configuration, to restrict the passage of fluids through the port and into the throughbore of the tubular;

(c) locking the flow control device in the closed position against the bias of a resilient device;

(d) applying pressure to a piston so as to unlock the flow control device from the closed position, thereby permitting the flow control device to change configuration to an open configuration, thereby permitting fluids to pass through the port and into the throughbore of the tubular;

(e) allowing pressure equalisation through a valved port of the piston between opposite axial sides of the piston; and (f) recovering fluids from the throughbore of the tubular.

* * * * *